US011046108B2

(12) United States Patent
Burke

(10) Patent No.: US 11,046,108 B2
(45) Date of Patent: Jun. 29, 2021

(54) PAINT ROLLER CLEANING SYSTEM

(71) Applicant: Michael Burke, Ann Arbor, MI (US)

(72) Inventor: Michael Burke, Ann Arbor, MI (US)

( * ) Notice: Subject to any disclaimer, the term of this patent is extended or adjusted under 35 U.S.C. 154(b) by 625 days.

(21) Appl. No.: 15/807,523

(22) Filed: Nov. 8, 2017

(65) Prior Publication Data

US 2018/0147883 A1 May 31, 2018

Related U.S. Application Data

(60) Provisional application No. 62/426,444, filed on Nov. 25, 2016.

(51) Int. Cl.
*B44D 3/00* (2006.01)

(52) U.S. Cl.
CPC ..... *B44D 3/006* (2013.01)

(58) Field of Classification Search
None
See application file for complete search history.

(56) References Cited

U.S. PATENT DOCUMENTS

| | | | | |
|---|---|---|---|---|
| 3,587,599 | A | 6/1971 | Bywater | |
| 3,897,797 | A | 8/1975 | Wright | |
| 4,130,124 | A | 12/1978 | Sherwin | |
| 4,711,258 | A | 12/1987 | Rossborough | |
| 5,402,808 | A | 4/1995 | Wallis | |
| D549,750 | S * | 8/2007 | Sim | D15/143 |
| 2015/0328657 | A1 * | 11/2015 | Kenny, Jr. | B08B 3/02 134/198 |

* cited by examiner

*Primary Examiner* — Rita P Adhlakha

(57) ABSTRACT

A paint roller cleaning system including an elongated cylindrical member configured to receive a paint roller, a first-end-cap, and a second-end-cap. The first-end-cap for attachment at a first-end of the elongated cylindrical member and the second-end-cap for attachment at a second-end of the elongated cylindrical member. The first-end-cap includes a threaded-member and may couple to a water supply and direct water through a receiving-aperture. The second-end-cap includes an exit-aperture and a positioning-member for positioning the paint roller above the exit-aperture allowing for water to drain therethrough. The paint roller cleaning system may be used for cleaning a paint roller when inserted into the elongated cylindrical member and the water supply is activated.

19 Claims, 5 Drawing Sheets

PAINT ROLLER CLEANING SYSTEM

CROSS REFERENCE TO RELATED APPLICATION

The present application is related to and claims priority to U.S. Provisional Patent Application No. 62/426,444 filed Nov. 25, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of cleaning tools and more specifically relates to a paint roller cleaning device.

2. DESCRIPTION OF RELATED ART

Many painters use paint rollers. A paint roller is a paint application tool used for painting large flat surfaces rapidly and efficiently. It typically consists of two parts: a roller frame, and a roller cover. The roller cover absorbs the paint and transfers it to the painted surface; the roller frame attaches to the roller cover. A painter holds the roller by the handle section. Paint rollers may be disposed of, or cleaned for future use; however, cleaning a paint roller can be a daunting task. Typically, a roller must be cleaned by hand, which can be messy. Washing the roller can be time consuming and it prevents the individual from cleaning up other supplies during the process. If more than one roller needs to be cleaned, the task can take even longer. A more efficient method is needed.

U.S. Pat. No. 4,711,258 to Richard F. Rossborough relates to an apparatus for cleaning paint rollers. The described apparatus for cleaning paint rollers includes an apparatus for cleaning a paint roller having a handle, connecting arm (17) and roller cover (18), the apparatus consisting of a hollow cylindrical housing (1), a water outlet member (10), and a locating clip (6) with three pairs of fingers for resiliently holding the connecting arm (17) of the paint roller in a predetermined position while water under pressure from the water outlet member (10) is directed so as to strike the roller cover (18) such that the roller cover (18) rotates thereby cleaning the paint roller.

BRIEF SUMMARY OF THE INVENTION

In view of the foregoing disadvantages inherent in the known cleaning tools art, the present disclosure provides a novel paint roller cleaning system. The general purpose of the present disclosure, which will be described subsequently in greater detail, is to provide a device to simplify cleaning of paint rollers.

A paint roller cleaning system is disclosed herein. The paint roller cleaning system includes an elongated cylindrical member configured to receive a paint roller, a first-end-cap, and a second-end-cap. The elongated cylindrical member has a first-end and a second-end. The first-end-cap is configured for attachment at the first-end of the elongated cylindrical member. The second-end-cap configured for attachment at the second-end of the elongated cylindrical member. The first-end-cap comprises a threaded-member and may couple to a water supply and direct water through a receiving-aperture. The second-end-cap comprises an exit-aperture and a positioning-member for positioning the paint roller above the exit-aperture allowing for water to drain therethrough. The paint roller cleaning system is configured for cleaning the paint roller when inserted into the elongated cylindrical member and the water supply is activated and the water is directed through the receiving-aperture, through the elongated cylindrical member, and out the exit-aperture.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a paint roller cleaning system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to cleaning tools and more particularly to a paint roller cleaning system as used to improve the efficiency of cleaning paint rollers.

Generally, the present invention provides a paint roller cleaner that saves users time and energy when washing roller covers. It includes a tube that fits snugly around a roller to force water through the fibers under pressure. This enables homeowners and professional painters to clean 18-inch roller covers in under a minute. The present invention utilizes a water hose to provide water and with pressure of flow it effectively washes away paint without the need for the user to manually squeeze out the roller. Paint roller cleaning system provides users with a quick and effective method for cleaning 18-inch paint roller covers. Other sizes may be cleaned as well.

The device includes a cylindrical body and a water hose attachment. The paint roller cover may be inserted into the cylindrical body portion and using water fed under pressure, the paint roller cover is cleaned. The tubing may be made from PVC piping or other high grade plastic materials with entry and exit holes for the water to flow through. The cylindrical mold fits snugly around the roller to force water through the fibers and out a smaller hole at the end to create pressure. Users may place roller caps on the roller itself to force the water to flow on the outside rather than through the middle of the roller.

Figure 1:
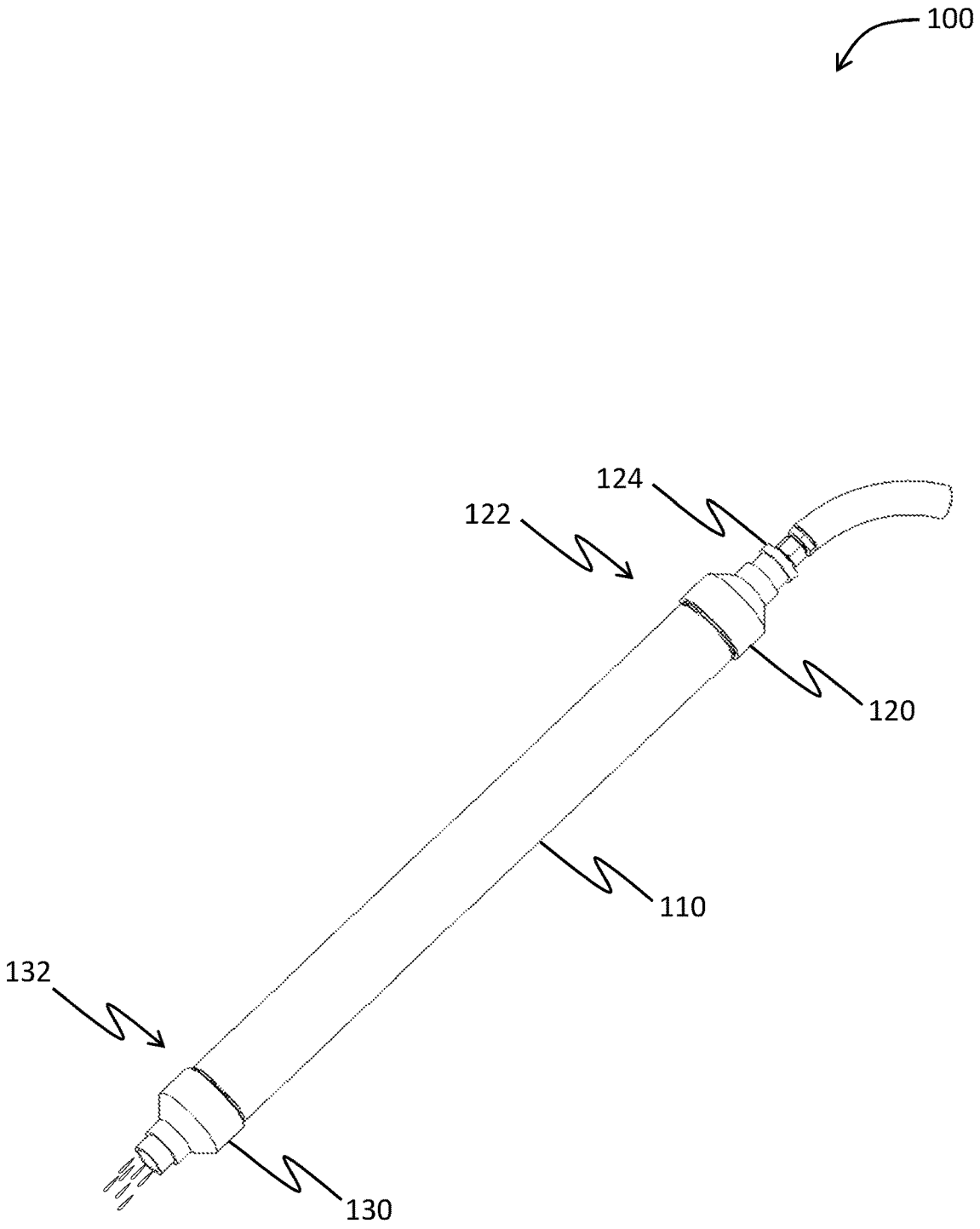
FIG. 1 is a perspective view of the paint roller cleaning system during an 'in-use' condition, according to an embodiment of the disclosure.

Referring now more specifically to the drawings by numerals of reference, there is shown in FIGS. 1-5, various views of a paint roller cleaning system 100. FIG. 1 shows a paint roller cleaning system 100 during an 'in-use' condition 150, according to an embodiment of the present disclosure. As illustrated, the paint roller cleaning system 100 may include an elongated cylindrical member 110 configured to receive a paint roller 10, a first-end-cap 120, and a second-end-cap 130. The elongated cylindrical member 110 has a first-end 122 and a second-end 132. The first-end-cap 120 is configured for attachment at the first-end 122 of the elongated cylindrical member 110. The second-end-cap 130 is configured for attachment at the second-end 132 of the elongated cylindrical member 110. The first-end-cap 120 comprises a threaded-member 124 and is configured to couple to a water supply and direct water through a receiving-aperture. The second-end-cap 130 comprises an exit-aperture and a positioning-member 134 for positioning the paint roller 10 above the exit-aperture allowing for water to drain therethrough. The paint roller cleaning system 100 is configured for cleaning the paint roller when inserted into the elongated cylindrical member 110 and the water supply is activated and the water is directed through the receiving-aperture, through the elongated cylindrical member 110, and out the exit-aperture.

Figure 2:
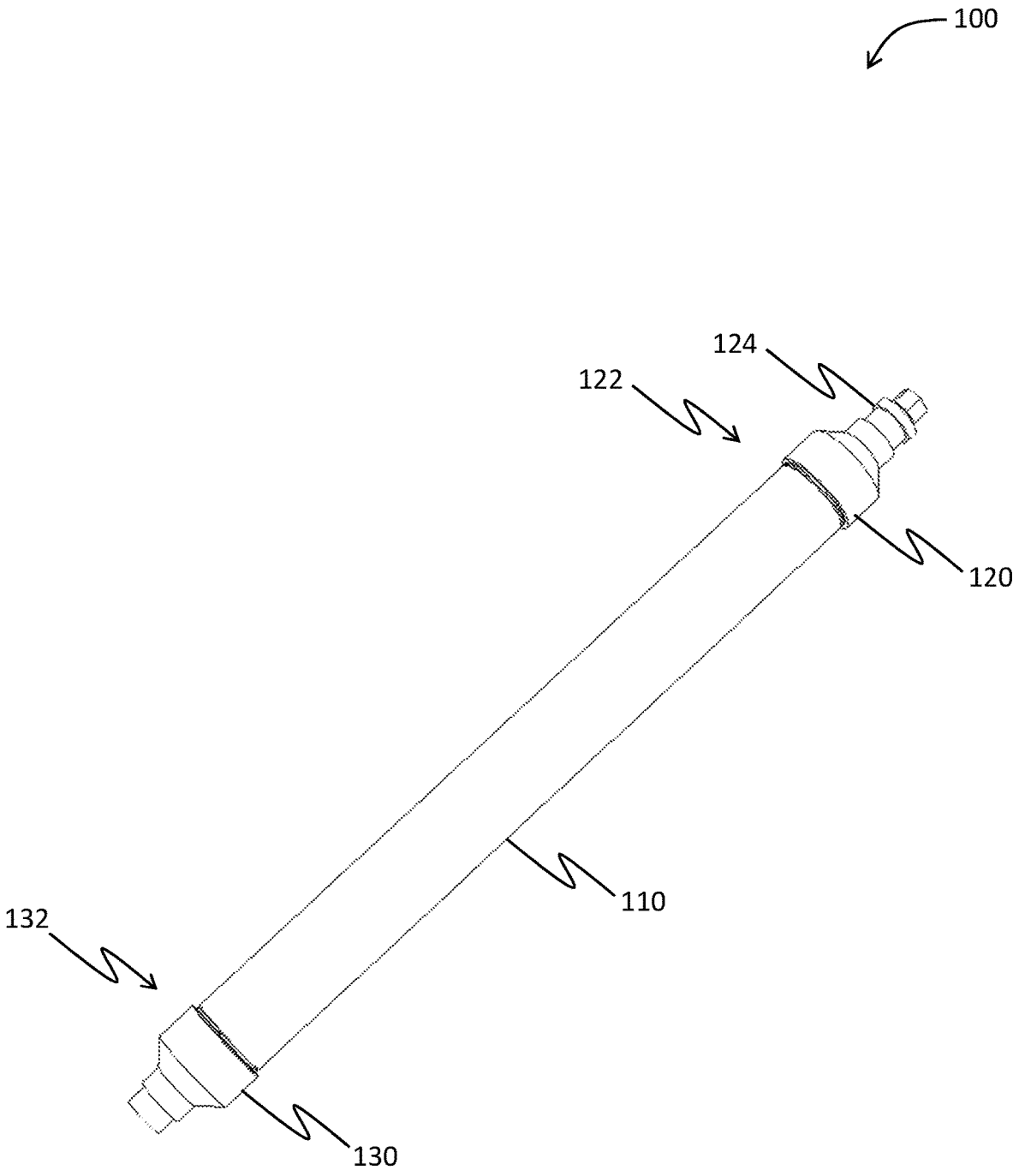
FIG. 2 is a perspective view of the paint roller cleaning system of FIG. 1, according to an embodiment of the present disclosure.

Referring now to FIG. 2 showing a perspective view of the paint roller cleaning system 100 of FIG. 1, according to an embodiment of the present disclosure. As above, the paint roller cleaning system 100 may include the elongated cylindrical member 110, the first-end-cap 120, and the second-end-cap 130. The second-end-cap 130 comprises a substantially similar profile to the first-end-cap 120. The first-end-cap 120 and the second-end-cap 130 may be removeably coupleable to the elongated cylindrical member 110. The elongated cylindrical member 110, the first-end-cap 120, and the second-end-cap 130 may comprise polyvinyl chloride pipe (PVC), hard plastic, or other suitable material. The elongated cylindrical member 110, the first-end-cap 120, and the second-end-cap 130 comprise a water-tight seal when secured in an in-use position. In a preferred embodiment the threaded-member 124 comprises a garden house fitting. The water supply is transferred through a garden hose which may be attached to the threaded-member 124. Water may then be directed through the receiving-aperture and pressurized through the elongated cylindrical member 110 to clean the paint roller.

The paint roller 10 when inserted into the elongated cylindrical member 110 allows a tolerance between such that the water can be pushed across and along a length of the paint roller 10 such that the water is able to remove paint-residue. The paint roller cleaning system 100 further includes an end-cap 140 configured to be secured to a paint-roller-end of the paint roller 10 and force the water between an interior-surface of the elongated cylindrical member 110 and an outer-surface of the paint roller 10. The end-cap 140 directs water between the interior-surface of the elongated cylindrical member 110 and the outer-surface of the paint roller 10 rather than an inner-surface of the paint roller 10.

Figure 3:
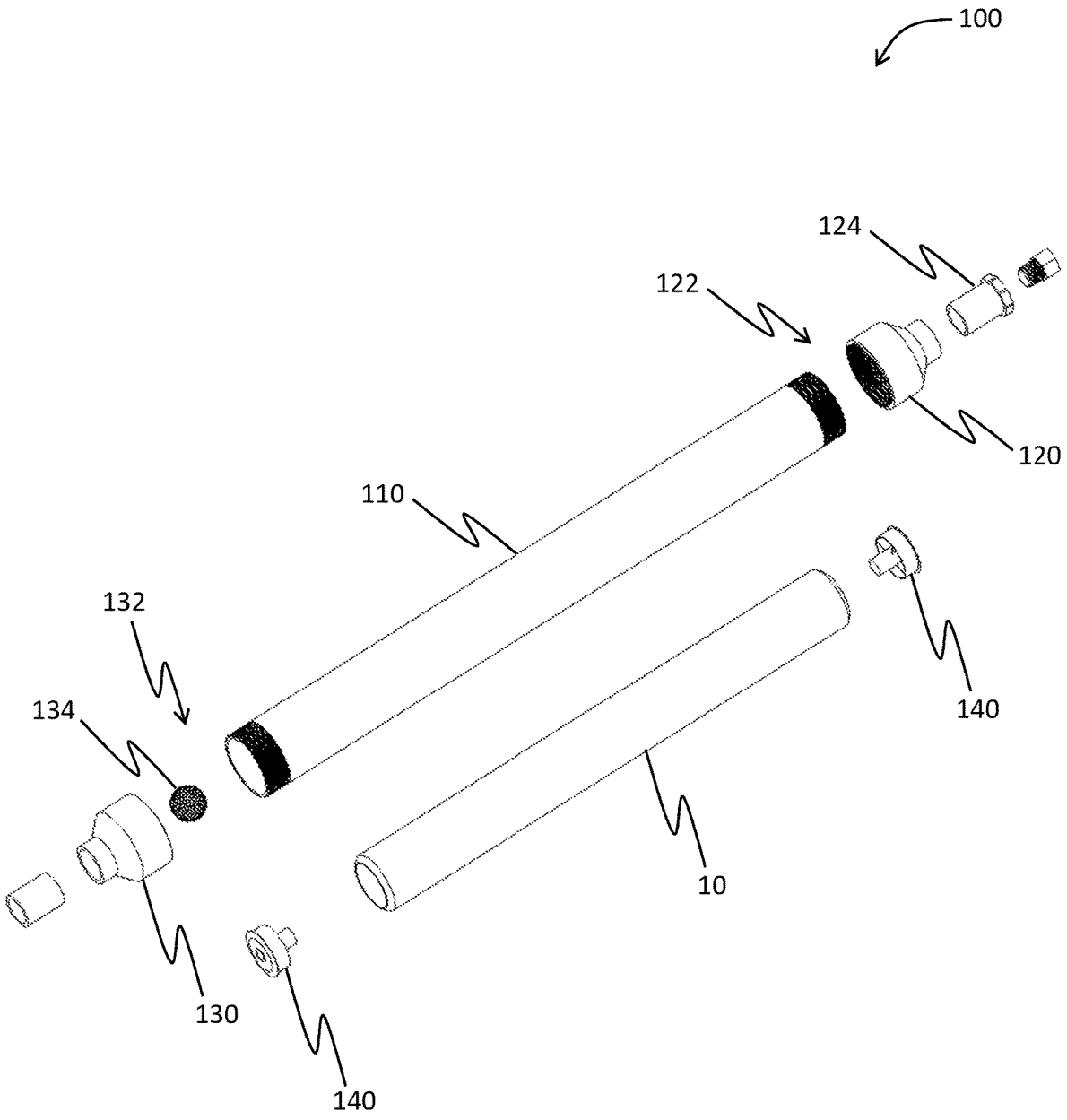
FIG. 3 is a perspective view of the paint roller cleaning system of FIG. 1, according to an embodiment of the present disclosure.

FIG. 3 shows a perspective view of the paint roller cleaning system 100 of FIG. 1, according to an embodiment of the present disclosure. As above, the paint roller cleaning system 100 may include the elongated cylindrical member 110, the first-end-cap 120, and the second-end-cap 130. The first-end-cap 120 comprises the threaded-member 124 and is configured to couple to the water supply and direct water through the receiving-aperture. The second-end-cap 130 comprises the exit-aperture and the positioning-member 134 for positioning the paint roller 10 above the exit-aperture allowing for water to drain therethrough.

The positioning-member 134 may include a spherical shape similar to a ball and is configured within a recess on a base of the second-end-cap 130. The positioning-member 134 may include a plurality of holes configured to provide an exit for the water through the exit-aperture. The positioning-member 134 allows water to flow therethrough. The positioning-member 134 and the recess are approximately 1 inch in diameter. The positioning-member 134 is affixed within the recess as the water flows through the exit-aperture. The positioning-member 134 elevates the paint roller 10 in a position slightly above the exit-aperture to allow water to pass.

Figure 4:
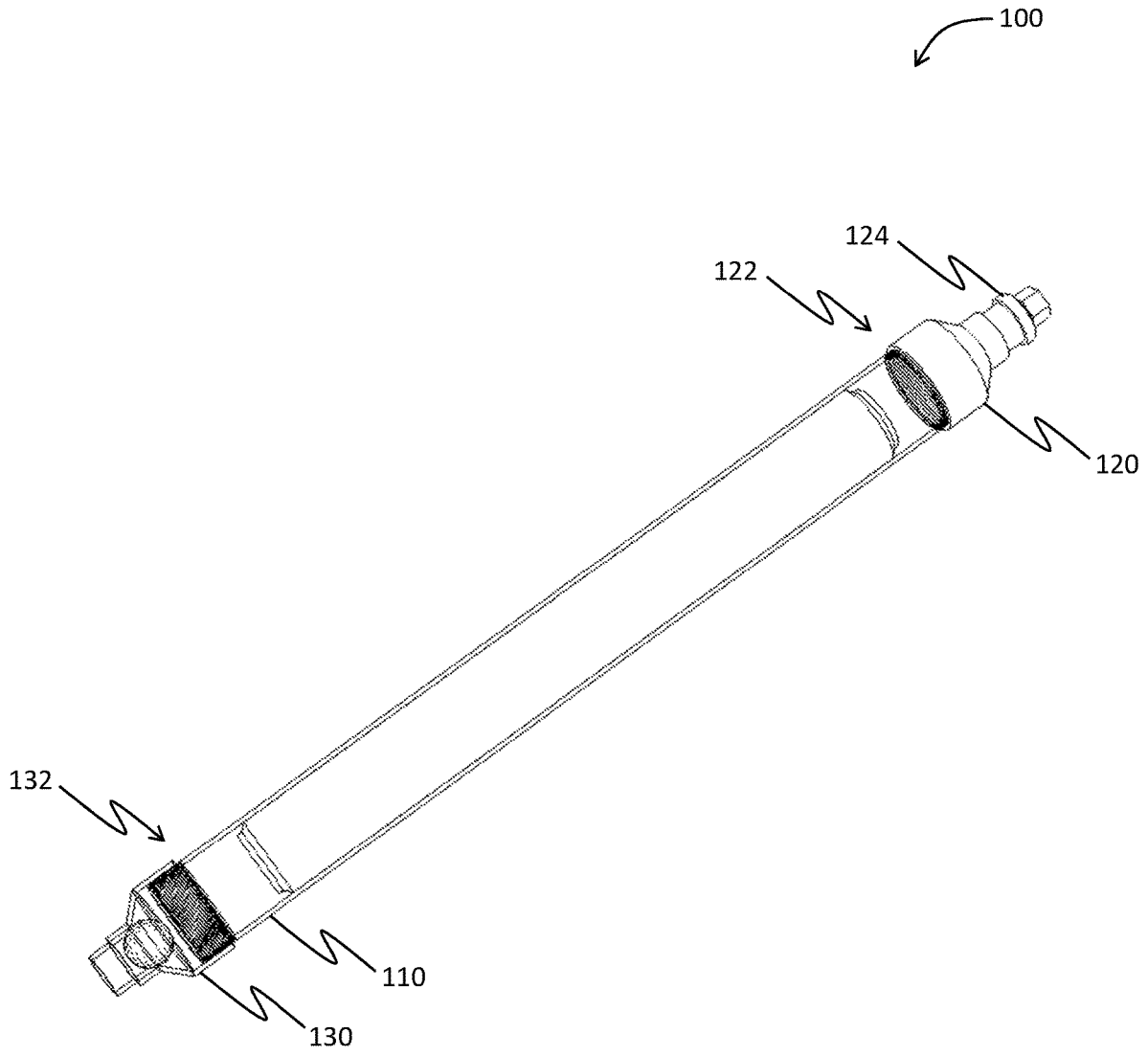
FIG. 4 is a perspective view of the paint roller cleaning system of FIG. 1, according to an embodiment of the present disclosure.

FIG. 4 shows a perspective view of the paint roller cleaning system 100 of FIG. 1, according to an embodiment of the present disclosure. As above, the paint roller cleaning system 100 may include the elongated cylindrical member 110, the first-end-cap 120, and the second-end-cap 130. In a preferred embodiment, the elongated cylindrical member 110 comprises an elongated-cylindrical-member-length of approximately 20 inches and an elongated-cylindrical-member-diameter of approximately 2 inches such that the elongated cylindrical member 110 is configured to receive a paint roller 10. The paint roller 10 may comprise a roller-length of approximately 18 inches. Other sizes and shapes may be used.

Figure 5:
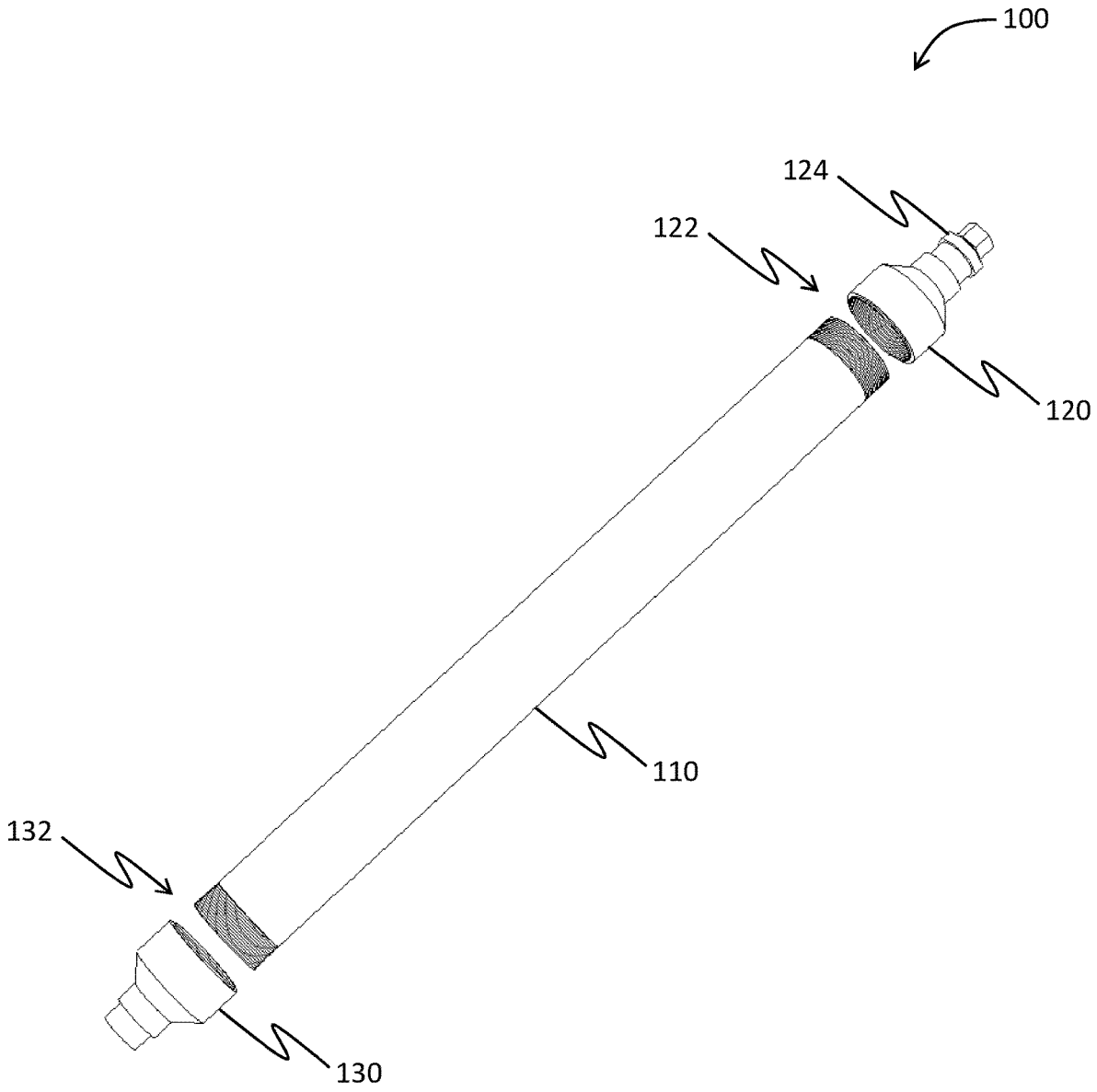
FIG. 5 is another perspective view of the paint roller cleaning system of FIG. 1, according to an embodiment of the present disclosure.

FIG. 5 shows another perspective view of the paint roller cleaning system 100 of FIG. 1, according to an embodiment of the present disclosure. As above, the paint roller cleaning system 100 may include the elongated cylindrical member 110, the first-end-cap 120, and the second-end-cap 130. The end-cap 140 may include an end-cap-recess approximately 1-inch deep which is configured to receive a tool such as a screwdriver for removing the end-cap 140 from the paint-roller-end of the paint roller 10 after use. The end-cap 140 rigid and is friction fitted within the paint-roller-end of the paint roller 10 during use. The end-cap 140 directs water between the interior-surface of the elongated cylindrical member 110 and the outer-surface of the paint roller 10 rather than an inner-surface of the paint roller 10. This action creates greater water pressure for effectively cleaning the paint roller 10. The device may be used in a method of use as disclosed and shown in FIGS. 1-5.

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A paint roller cleaning system comprising:

an elongated cylindrical member configured to receive a paint roller, said elongated cylindrical member having a first-end and a second-end;

a first-end-cap configured for attachment at said first-end of said elongated cylindrical member;

a second-end-cap configured for attachment at said second-end of said elongated cylindrical member;

wherein said first-end-cap comprises a threaded-member and is configured to couple to a water supply and direct water through a receiving-aperture;

wherein said second-end-cap comprises an exit-aperture comprising one or more holes and a positioning-member comprising a plurality of holes located against said exit-aperture holes allowing for water to drain; and wherein said paint roller cleaning system is configured for cleaning said paint roller when inserted into said elongated cylindrical member and said water supply is activated and said water is directed through said receiving-aperture, through said elongated cylindrical member, and out said exit-aperture.

2. The paint roller cleaning system of claim 1, wherein said threaded-member comprises a garden hose fitting.

3. The paint roller cleaning system of claim 2, wherein said water supply is transferred through a garden hose.

4. The paint roller cleaning system of claim 1, wherein said paint roller when inserted into said elongated cylindrical member allows a tolerance between such that said water can be pushed across and along a length of said paint roller such that said water is able to remove paint-residue.

5. The paint roller cleaning system of claim 4, further includes an end-cap configured to be secured to a paint-roller-end of said paint roller and force said water between an interior-surface of said elongated cylindrical member and an outer-surface of said paint roller.

6. The paint roller cleaning system of claim 5, wherein said end-cap comprises an end-cap-recess configured to receive a tool for removing said end-cap from said paint-roller-end of said paint roller.

7. The paint roller cleaning system of claim 6, wherein said end-cap is friction fitted within said paint-roller-end of said paint roller.

8. The paint roller cleaning system of claim 1, wherein said positioning-member comprises a spherical shape configured within a recess on a base of said second-end-cap.

9. The paint roller cleaning system of claim 8, wherein said positioning-member holes are configured to provide an exit for said water through said exit-aperture.

10. The paint roller cleaning system of claim 9, wherein said positioning-member and said recess are 1 inch in diameter.

11. The paint roller cleaning system of claim 9, wherein said positioning-member is affixed within said recess as said water flows through said exit-aperture.

12. The paint roller cleaning system of claim 1, wherein said elongated cylindrical member comprises an elongated-cylindrical-member-length of 20 inches and an elongated-cylindrical-member-diameter of 2 inches.

13. The paint roller cleaning system of claim 1, wherein said end-cap is rigid.

14. The paint roller cleaning system of claim 1, wherein said second-end-cap comprises a substantially similar profile to said first-end-cap.

15. The paint roller cleaning system of claim 14, wherein said first-end-cap and said second-end-cap are removeably coupleable to said elongated cylindrical member.

16. The paint roller cleaning system of claim 1, wherein said paint roller comprises a roller-length of 18 inches.

17. The paint roller cleaning system of claim 1, wherein said elongated cylindrical member, said first-end-cap, and said second-end-cap comprise polyvinyl chloride pipe (PVC).

18. The paint roller cleaning system of claim 1, wherein said elongated cylindrical member, said first-end-cap, and said second-end-cap comprises a water-tight seal when secured in an in-use position.

19. A paint roller cleaning system comprising:

an elongated cylindrical member configured to receive a paint roller, said elongated cylindrical member having a first-end and a second-end;

a first-end-cap configured for attachment at said first-end of said elongated cylindrical member;

a second-end-cap configured for attachment at said second-end of said elongated cylindrical member;

wherein said elongated cylindrical member, said first-end-cap, and said second-end-cap comprise polyvinyl chloride pipe (PVC);

wherein said second-end-cap comprises a substantially similar profile to said first-end-cap;

wherein said first-end-cap and said second-end-cap are removeably coupleable to said elongated cylindrical member;

wherein said paint roller cleaning system includes an end-cap configured to be secured to a paint-roller-end of said paint roller and force said water between an interior-surface of said elongated cylindrical member and an outer-surface of said paint roller;

wherein said end-cap comprises an end-cap-recess configured to receive a tool for removing said end-cap from said paint-roller-end of said paint roller;

wherein said end-cap is friction fitted within said paint-roller-end of said paint roller;

wherein said end-cap is rigid;

wherein said elongated cylindrical member comprises an elongated-cylindrical-member-length of 20 inches and an elongated-cylindrical-member-diameter of 2 inches;

wherein said paint roller comprises a roller-length of 18 inches;

wherein said elongated cylindrical member, said first-end-cap, and said second-end-cap comprises a water-tight seal when secured in an in-use position;

wherein said first-end-cap comprises a threaded-member and is configured to couple to a water supply and direct water through a receiving-aperture;

wherein said threaded-member comprises a garden hose fitting;

wherein said water supply is transferred through a garden hose;

wherein said second-end-cap comprises an exit-aperture comprising one or more holes and a positioning-member comprising a plurality of holes located against said exit-aperture holes allowing for water to drain; and wherein said paint roller when inserted into said elongated cylindrical member allows a tolerance between such that said water can be pushed across and along a length of said paint roller such that said water is able to remove paint-residue;

wherein said positioning-member comprises a spherical shape configured within a recess on a base of said second-end-cap;

wherein said positioning-member comprises holes configured to provide an exit for said water through said exit-aperture;

wherein said positioning-member and said recess are 1 inch in diameter;

wherein said positioning-member is affixed within said recess as said water flows through said exit-aperture; and wherein said paint roller cleaning system is configured for cleaning said paint roller when inserted into said elongated cylindrical member and said water supply is activated and said water is directed through said receiving-aperture, through said elongated cylindrical member, and out said exit-aperture.

* * * * *